United States Patent [19]

Mattiussi

[11] Patent Number: 4,850,378

[45] Date of Patent: Jul. 25, 1989

[54] STEEL PICKLING APPARATUS

[75] Inventor: Al Mattiussi, Stoney Creek, Canada

[73] Assignee: Nelson Steel, Stoney Creek, Canada

[21] Appl. No.: 108,237

[22] Filed: Oct. 14, 1987

[51] Int. Cl.[4] ..... B08B 1/02

[52] U.S. Cl. ..... 134/15; 134/25.1; 134/25.4; 134/28; 134/26; 134/114; 134/64 R

[58] Field of Search ..... 134/15, 28, 25.4, 25.5, 134/10, 26, 60, 61, 64 R, 68, 72, 114, 41, 29, 22.1; 220/400, 401, 403, 407, 410; 210/500

[56] References Cited

U.S. PATENT DOCUMENTS 4,592,784 6/1986 Ghizzi ..... 134/15

4,707,191 11/1987 Martinai et al. ..... 134/29

*Primary Examiner*—H. M. S. Sneed

*Assistant Examiner*—Sharon T. Cohen

*Attorney, Agent, or Firm*—Rogers, Bereskin & Parr

[57] ABSTRACT

An improved bath for use in pickling of steel strip manufactured in a hot strip mill. Pickling fluid, usually acid, is supplied to the bath through apertures in the sidewalls of the bath. A plurality of apertures are provided spaced at differing heights from the bottom of the bath so that acid may be supplied to the bath at various fluid depths. Advantageously, the bath comprises downwardly and inwardly sloping surfaces and the outlets of the apertures are elliptical in shape. In this manner the bath accommodates steel strip of varying widths while ensuring addition of acid to the bath adjacent the edges of the steel strip. Improved agitation of the fluid in the bath enhances the throughput speed of steel strip. To further enhance agitation the inlet apertures are arranged to introduce pickling fluid in a direction which so countercurrent to the direction of movement of steel through the bath.

11 Claims, 2 Drawing Sheets

STEEL PICKLING APPARATUS

This invention relates to improvements in the baths used in the pickling of steel.

When steel is manufactured in a steel mill it can take various physical forms. In some cases steel is manufactured in a form of product useful as structural steel, railway rails, reinforcing bars and the like. One of the most common forms of steel manufacturing involves the manufacture of steel in a strip which is relatively thin gauge compared to its width. Steel manufactured in this form is typically wound into coils weighing many thousands of pounds.

Coil steel is manufactured in the steel mills and wound into coils while at a very high temperature. Because of exposure of the steel to ambient air at the high temperature a coating of iron oxide forms of the steel as it is being wound into a coil. Prior to utilization of the steel in any further manufacturing processes, it is usually required that the steel be treated so as to remove the layer of iron oxide which has formed on its surface. This operation is referred to as pickling of steel.

The conventional method of pickling steel is to pass the steel through a bath of hydrochloric acid. The acid removes the iron oxide layer and leaves a bright clean steel finish. The steel is then oiled and rewound into a coil format for use at a subsequent manufacturing stage. The steel coil is passed through a bath having considerable length during which time the steel is immersed in a pickling liquid. The bath may contain several separate stages with pickling liquid being supplied at the appropriate rate to maintain the acid treatment of the surface of the steel. Because the steel when coated with iron oxide is quite abrasive, it has been known to manufacture a liner for the baths manufactured from acid resistant brick or granite. These substances are suitably resistant to the acids normally used in pickling of steel and are sufficiently hard to withstand the abrasiveness of the steel strip as it passes along the bath.

The pickling baths may be of any convenient depth, width and configuration. Some pickling baths are generally rectangular shaped with a flat bottom and substantially vertical walls. Other variations however are commonly used.

In previous baths manufactured by the patentee, a relatively shallow configuration of bath has been used. The bath has a V-shape having a lower apex. Regardless of the configuration of the bath, pickling liquid is typically supplied to the bath through openings in a cover forming the top of the bath. Typically, the pickling line comprises a plurality of individual baths with the pickling liquid being recirculated in each section to maintain appropriate control of the pickling chemistry. The speed at which the steel strip can be moved through the bath is determined by the interaction of the amount of iron oxide on the surface of the steel and the conditions in the pickling bath.

While existing pickling baths including those made according to the patentee's technology have been satisfactory, there remains the constant desire to increase the throughput of steel through a bath of any particular configuration in order to increase the efficient use of the bath facility.

According to this invention, improved throughput of steel is obtained by supplying pickling liquid to a bath through a plurality of apertures located in either side wall of the bath. The apertures through which the pickling liquid is supplied are arranged at an acute angle to direct flow of incoming liquid countercurrent to the direction of travel of the steel through the bath. Substantially increased turbulence is achieved which aids in obtaining higher throughput of steel strip.

According to the invention an improved bath for pickling of steel comprises a relatively shallow lined pickling tank. The lining comprises opposite outside side faces. Each of the side faces of the lining and the pickling tank having apertures extending from the outside of the tank to the inside of the tank through which pickling liquid may be introduced. The longitudinal axis of the aperture for introduction of pickling liquid is preferrably aligned at an acute angle to the direction of travel of the steel through the bath to direct incoming pickling liquid in a direction countercurrent to the direction of travel of steel through the bath. Each of the side faces of the tank and lining involve a plurality of apertures arranged at different vertical heights above the bottom of the tank so that at least some of the pickling liquid is introduced adjacent the edge of the steel strip passing through the bath.

According to this invention an improved process for pickling treatment of steel strip involves the addition of pickling fluid to a trough containing such fluid through the side walls of the trough. Apertures through which incoming fluid is added to the bath may be arranged at different heights above the bottom of the trough so that fluid is introduced at different fluid depths so that for most widths of steel strip at least some fluid is introduced adjacent the two side edges of the strip. Fluid is supplied at a rate to provide turbulence in the trough to assist in the treatment of the steel strip. Advantageously, the fluid is introduced at an acute angle to the direction of movement of the strip with at least a component of the direction of the incoming fluid being counter current to the direction of movement of the strip. Increased turbulence according to this improved process will permit increased throughput of steel strip as compared to previously used processes.

Further and other features of the invention will be more clearly appreciated following reference to the following description of a preferred embodiment of the invention in which.

Figure 1:
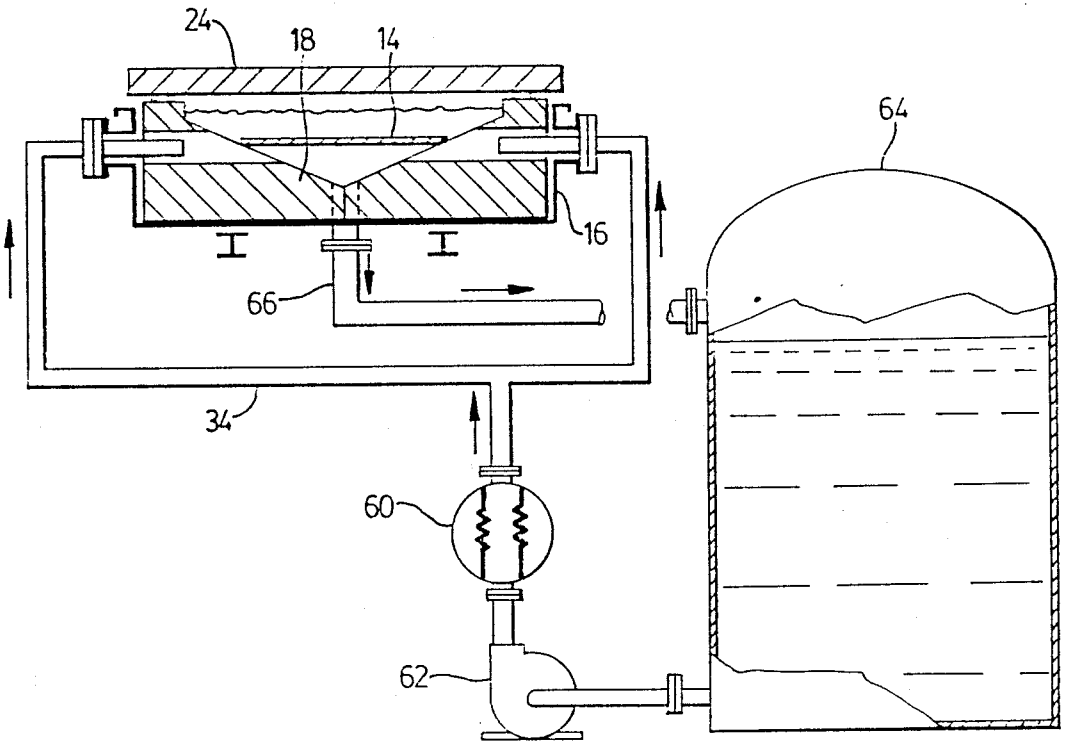
FIG. 1 illustrates a cross-section through the preferred embodiment of a pickling tank in accordance with the invention and illustrating in schematic fashion a typical recirculating system.

A preferred embodiment of the improved pickling apparatus is illustrated in the Figures. The bath 10 comprises an elongate structure which contains pickling fluid 12 in which a steel strip 14 is immersed for treatment.

The bath comprises a steel tank 16. The steel tank 16 is relatively shallow as compared with its width. The steel tank is supported throughout its length by appropriate structural members.

The steel tank 16 of this embodiment is lined by two granite liners 18. The two granite liners meet at the centre of the tank. The surface between the two granite liners is sealed by means of sealant 20. Sealant 20 is also placed between the granite liners and the side walls of the tank 16 to ensure that the pickling fluid 12 does not come into contact with the steel tank 16.

Figure 2:
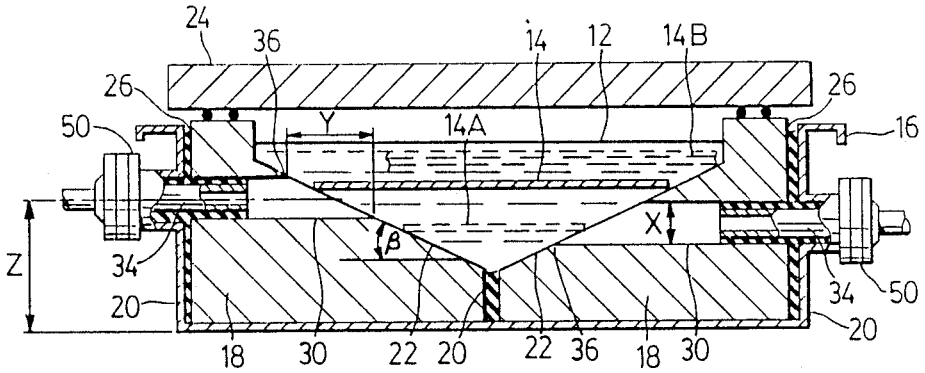
FIG. 2 is an enlarged version of FIG. 1 illustrating in more detail the cross-sectional configuration of the improved pickling tank.

The upper surface 22 of the granite liners defines the cavity maintaining the pickling liquid and through which the steel strip 14 passes during the pickling process. The granite liners converge inwardly and downwardly at an angle $\beta$ as shown in FIG. 2 to the central axis of the pickling tank. The upper surface of the granite liners thus constitutes a relatively shallow bath containing the pickling liquid. The granite liners also have a substantially vertical exterior face 26 which abuts the steel tank 16. The bath is closed to prevent escape of fumes and liquid by means of a granite cover 24.

During the pickling operation the steel strip 14 is passed along the granite liners 18 and through the pickling fluid 12. The edges of the steel strip 14 rest on the upper surfaces 22 of the granite liners. When a strip is first fed into the pickling apparatus it is pushed from the coil end. When the leading edge of the steel strip emerges from the bath it is then grasped and a new coil is wound at the exit end. These types of bath are traditionally know as push-pull treatment baths.

The improved bath according to this invention is also suited for use with a continuous processing system. In the continuous system often used in steel mills, new coils are welded or stitched to the end of a preceding coil. In this manner, all coils are pulled through the bath. The strip may be tensioned to maintain a catenary curve when in the bath as is well understood by those familiar with steel pickling. Although the bath configuration may be different, the present invention is approprite for use in baths of this type.

As shown in FIG. 2 the push-pull bath constructed with granite liners having an angle $\beta$ is adapted to receive steel strips of variable widths. A narrower steel strip is shown in dotted lines and identified as strip 14A. This strip will ride lower down in the bath closer to the bottom of the bath. A somewhat wider strip 14B is also shown in dotted lines. Because of its greater width the strip 14B rides higher up in the granite liners. By reason of the use of the angled surface of the granite liners a number of different width steel strips can be accommodated in a single apparatus.

Figure 3:
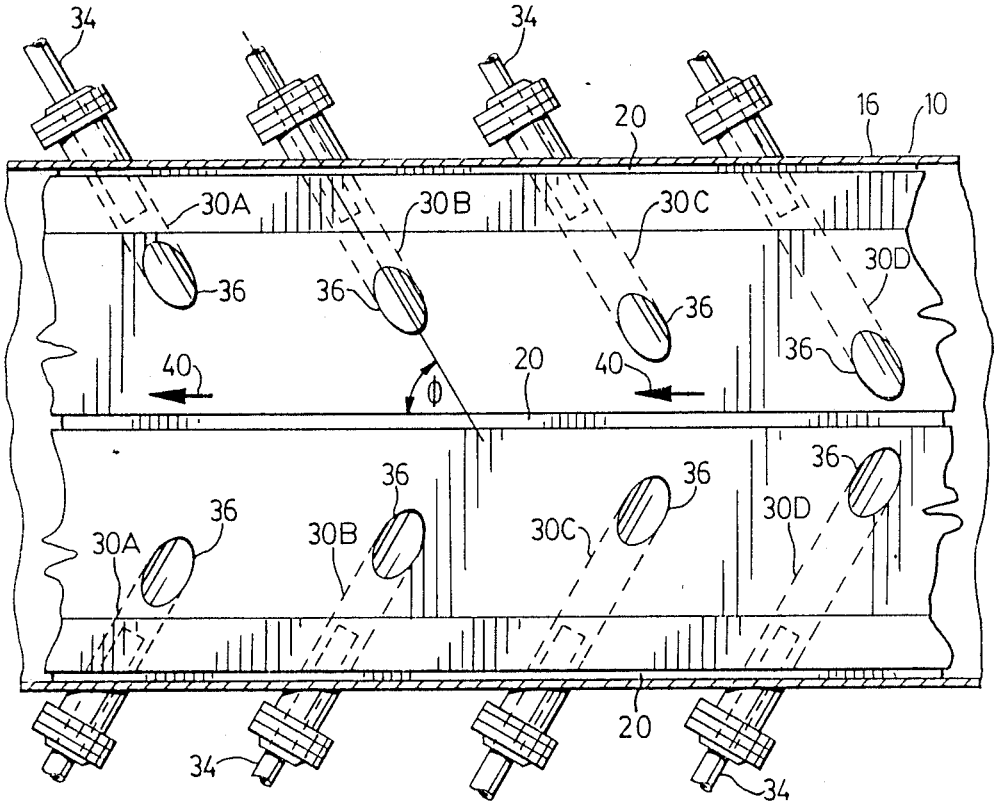
FIG. 3 is a plan view of the improved pickling tank of FIG. 1.

From reference to FIGS. 2 and 3 it will be noted that each of the granite liners 18 has an aperture 30 extending from the exterior substantially vertical face 26 through to the inclined face 22. The aperture 30 may be drilled through the granite and is aligned with a similar circular passage in the steel tank 16. Suitable piping 34 for conveying the pickling fluid is inserted into the aperture 30 drilled through the granite to provide entry of acid into the bath. The pipes 34 are illustrated in FIG. 2 passing through each of the granite liners 18.

From reference to FIG. 2 it will be noted that the axis of the aperture 30 is approximately horizontal and is located at a distance Z above the bottom of the steel tank 16. From reference to FIG. 3 it will be appreciated that the apertures 30 terminating in the upper face 22 present an elliptical shaped opening 36 in the upper surface of the granite liners 18. The elliptical opening 36 has a minor axis equal to the diameter of the aperture and a major axis which is a function of the angle $\beta$. The dimension Y which is the horizontal component of the major axis of the ellipse is shown in FIG. 2.

From reference to the dotted lines identifying a narrower steel strip 14A in FIG. 2, it will be appreciated that for a vertical location Z of any particular aperture 30 there can be a change in the width of the steel strip equal to 2Y while the edge of the strip will remain adjacent to the aperture 30.

To further accommodate wider strips of steel such as 14B illustrated in dotted lines in FIG. 2, or narrower strips which are even narrower than strip 14A, the apertures 30 are staggered at varying heights Z from the bottom of the steel tank 16 along the length of the bath. However, in each case the aperture 30 communicates with the upper surface 22 of the granite liners 18. This permits introduction of fluid to the tank at various fluid depths.

In FIG. 3 the steel strip when being treated passes in the direction from right to left as shown by the arrow labelled strip direction 40. The longitudinal axis of each aperture 34 through the granite liners 18 is directed at an acute angle $\phi$ countercurrent to the direction of travel of the strip. This structure steers incoming fluid into the bath in a direction of which a component is countercurrent to the direction of travel of steel strips.

It is apparent in the plan view in FIG. 3 that the apertures 30 are arranged at varying heights Z from the bottom of the trough. Aperture 30A intersects the upper surface 22 of granite liners 18 relatively remote from the centre seal 20 of the treatment bath. Thus, apertures 30A will introduce fluid adjacent the edge of a relatively wide strip. Apertures 30B intersect the upper surface 22 of the granite liners 18 nearer to the centre seal 20 of the treatment bath thus introducing the fluid adjacent the edges of a relatively narrow steel strip. Apertures 30D introduce pickling fluid quite near the centre seal 20 and accordingly below most strips treated in the bath.

From reference to all three Figures it will be appreciated that pickling fluid is introduced into the bath through a plurality of apertures 30 at varying heights from the bottom of the steel tank. Each of the pipes 34 is sealed into an appropriate fitting 50 to prevent any leakage from the trough. Piping 34 is connected to a heat exchanger 60 which in turn is connected to a pump 62. Pump 62 withdraws pickling fluid from a recirculating tank 64. Pickling fluid which has been introduced into the bath and is spent drains from the bath through suitable apertures and drainline 66 into the recirculating tank. Various controls can be provided in the usual fashion for maintenance of the pH and other appropriate conditions of the pickling fluid in the recirculating tank. The pump 62 passes the recharged pickling fluid through the heat exchanger 60 to provide the appropriate bath temperature. From reference to FIG. 3 it will be appreciated that the pickling fluid enters through the apertures 30 and passes into the bath in an upstream direction. For almost all widths of steel strip some of the entering fluid will be immediately adjacent the edge of the strip. Other of the entering fluid will be below the steel strip while still other fluid will be entering above the steel strip. By arranging the apertures through the side of the tank there is ensured substantial turbulence in the fluid adjacent the upper and lower surfaces of the steel strip being treated. As in practice, most of the iron oxide is formed adjacent the edges of the strip; there is the greatest need for turbulence adjacent the edge of the strip. This is provided in the present apparatus by the fluid entry adjacent the edge of the strip.

Various weirs and the like may be arranged within the bath to promote a directional flow of the pickling fluid toward a suitable drain so that liquid flow is countercurrent to the direction of travel of steel through the bath.

It will be observed that the improved pickling bath according to this invention provides increased turbulence in the area most needed, that is, adjacent the edges of the plate and the bath is appropriate for treating strips of different widths.

Various changes and modifications may be made to the improved bath according to this invention without departing from the scope of the invention as defined in the appended claims.

I claim:

1. A process for continuous pickling treatment of steel strip having first and second side edges, in at least one elongate trough containing pickling fluid comprising, moving said steel strip longitudinally along said trough, continuously, and substantially horizontally and at varying depths of said fluid contained in said trough, introducing pickling fluid to said trough adjacent to said first and second side edges of said strip through the sides of the trough.

2. A process according to claim 1 comprising directing pickling fluid into said trough through a plurality of vertically staggered apertures extending through side walls of said trough.

3. A process according to claim 2 comprising directing fluid into said trough in a direction which is at least in part countercurrent to the direction of movement of said strip along said trough.

4. A process according to claim 3 comprising introduction of fluid to said trough at a velocity to cause turbulence in the fluid within said trough.

5. A process according to claim 4 wherein said turbulence is caused near said first and second side edges of said strip.

6. An apparatus for continuous pickling treatment of steel strip in which steel strip is passed through a bath of pickling fluid comprising a tank, liners for said tank, said liners forming a trough for retaining said bath of pickling fluid, said linear having opposed outside side faces engaging said tank, said tank comprising a lowermost generally horizontal surface, said apparatus having a plurality of apertures extending through said tank from said outside side faces through said liners for supply of fluid to said trough, each of said apertures having a longitudinal axis, said axis extending through said liners and being generally parallel with the plane of said steel strip, said axes of said apertures being substantially horizontal and vertically staggered at varying heights above said lowermost surface, whereby fluid may be supplied to said trough through said apertures at different depths of said bath.

7. The apparatus of claim 3 wherein said apertures terminate in openings in the upper surface of said liners which openings are of a generally eliptical configuration.

8. The apparatus of claim 7 wherein said longitudinal axis of at least some of said apertures projects toward the direction of travel of said steel strip through said trough at an acute angle.

9. The apparatus of claim 8 wherein said longitudinal axis intersects said direction of travel so as to introduce pickling fluid in a direction which is at least in part countercurrent to said direction of travel of steel strip.

10. The apparatus of claim 9, wherein said liners are granite.

11. The apparatus of claim 6 wherein said trough for retaining pickling fluid is formed by said linear having upper surfaces which converge inwardly and downwardly.

* * * * *

UNITED STATES PATENT AND TRADEMARK OFFICE

CERTIFICATE OF CORRECTION

PATENT NO. : 4,850,378

DATED : July 25, 1989

INVENTOR(S) : Al Mattiussi

It is certified that error appears in the above-identified patent and that said Letters Patent is hereby corrected as shown below:

Claim 6, column 6, line 6, change "linear" to -liners-.

Claim 11, column 6, line 37, change "linear" to -liners-.

Claim 7, column 6, line 22, change "3" to -6-.

Signed and Sealed this

Fifteenth Day of March, 1994

Bruce Lehman

*Attest:*

BRUCE LEHMAN

*Attesting Officer*

*Commissioner of Patents and Trademarks*